US006193491B1

(12) United States Patent
Cheng

(10) Patent No.: US 6,193,491 B1
(45) Date of Patent: Feb. 27, 2001

(54) ROTORS FOR SCREW COMPRESSOR

(75) Inventor: Hong-Yih Cheng, 5, Lane 26, Wu der Street, Tainan 700 (TW)

(73) Assignees: Hong-Yih Cheng, Tainan; Kuo Yu Industrial Co., Ltd., Taipei, both of (TW)

( * ) Notice: Subject to any disclaimer, the term of this patent is extended or adjusted under 35 U.S.C. 154(b) by 0 days.

(21) Appl. No.: 09/468,944

(22) Filed: Dec. 22, 1999

(51) Int. Cl.[7] ..... F04C 2/16
(52) U.S. Cl. ..... 418/201.3
(58) Field of Search ..... 418/201.3

(56) References Cited

U.S. PATENT DOCUMENTS 4,527,967 * 7/1985 Ingalls ..... 418/201.3

* cited by examiner

*Primary Examiner*—John J. Vrablik
(74) *Attorney, Agent, or Firm*—Rosenberg, Klein & Lee

(57) ABSTRACT

The rotors for screw compressor include a male rotor and a female rotor. The cross-sectional profile of the male rotor is composed of four circular curves, curves generated by two circular curves and a circular curve that are sequentially connected with each other. The cross-sectional profile of the female rotor is composed of eight curves generated by four circular curves, a curve generated by a point and three curves. They arc sequentially connected with each other. Not only the continuity of each curve is good, but also the continuity of the connecting section between the curves is excellent. So, the operation of the rotors can be kept smooth and the compression efficiency is enhanced.

1 Claim, 2 Drawing Sheets

ROTORS FOR SCREW COMPRESSOR

BACKGROUND OF THE INVENTION

The present invention relates to a pair of conjugating rotors for screw compressor in which the male rotor can drive the female rotor to rotate by the designed profiles. By means of the gap between the teeth of the male rotor and female rotor, fluid will be sucked in. And, by means of the shifting of the contacting point between the male rotor and female rotor, the fluid can be compressed into a high-pressure and high-speed state. The compression ratio can be raised to 2~15. If the fluid is oil or air, the compressed oil or air can be used to drive other mechanisms such as a control valve or a hydraulic cylinder. If the fluid is a coolant, the coolant can be compressed by the compressor and becomes a high-pressure coolant. This high-pressure coolant can be applied to an air-conditioner or a refrigerator. An excellent compressor must have three characteristics, which include high energy transfer efficiency, low vibration noise and low electricity consumption.

In order to achieve these three objects mentioned above, the male rotor and female rotor must be designed with special profiles. Theoretically, the movement transmission between the teeth of the male and female rotors is based on the theory of conjugating surfaces. For example, the power transmission of the conventional gear is based on the theory of conjugating surfaces. That is, once the profile of one of the male and female rotors is determined, the other rotor must be generated in accordance with the theory of conjugating surfaces. In the field of gear manufacture, such procedure is called generating method.This is just like traditional milling procedure. When a milling tool mills a work piece, except the milling tool's self-rotation at high speed, the milling tool also moves along a preset curve. After which, the remaining curved surface left on the work piece that is the so-called generated surface. In the present invention, the generating method is utilized. More specifically, the spiral outer surface of one of the rotors should be designed first. Second, the profiles of the tooth sections of the male rotor and female rotor of the screw compressor are designed. Then, in accordance with the generating method, the other profiles of the female and male rotors conjugating with the tooth sections are generated and sequentially connected with each other. Finally, such rotors can enhance the energy transfer efficiency, reduce the vibration noise and lower the power consumption.

The profiles of the male and female rotors of the conventional screw compressor are respectively composed of several curves. The presently used curves include circular curves, elliptic curves, etc. The circular curve has high transmissibility (such as good pressure angle) and good simplicity of curve so that it is advantageous in easy design and easy manufacturing. So, the circular curve is widely used. Parabolic curve and hyperbolic curve are relatively complicated. Elliptic curve is relatively poor. Therefore, these curves are not widely used. Polynomial curve had been designed and used in the past. The profiles of the rotors of the screw compressor of the present invention arc composed of multiple curves including circular curves, curves generated by circular curves and point generated curves.

SUMMARY OF THE INVENTION

It is therefore a primary object of the present invention to provide rotors for screw compressor by utilizing the generating method. First, the profiles of the tooth sections of the male rotor and female rotor of the screw compressor can be obtained. Second, in accordance with the generating method, the other profiles of the female and male rotors conjugating with the tooth sections are generated.

It is a further object of the present invention to provide rotors of screw compressor that can be easily manufactured.

It is still a further object of the present invention to provide rotors of screw compressor in which the energy transfer efficiency is increased and the vibration noise and electricity consumption are reduced.

The present invention can be best understood through the following description and accompanying drawings wherein:

DETAILED DESCRIPTION OF THE PREFERRED EMBODIMENT

Figure 1:
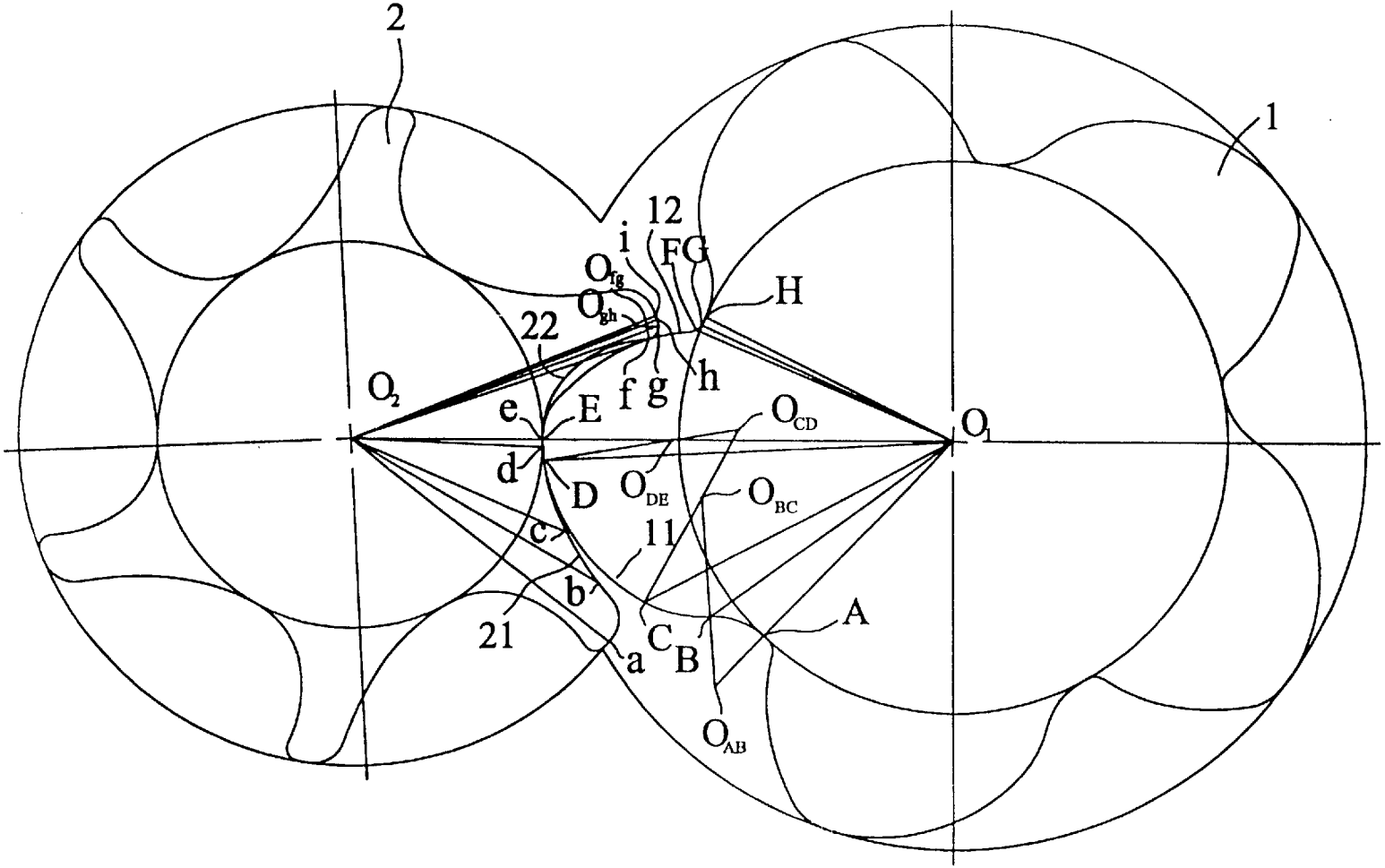
FIG. 1 is a diagram showing the profiles of the male and female rotors of the present invention.
Figure 2:
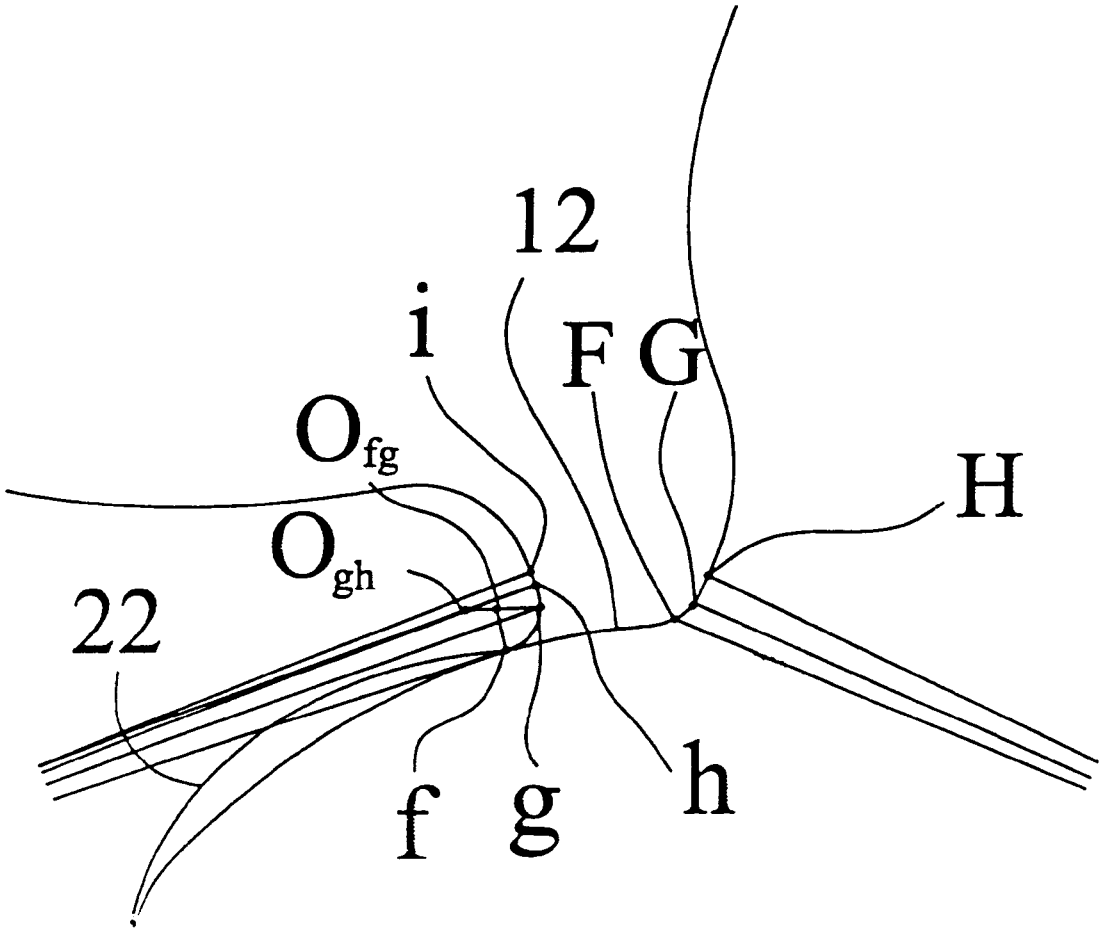
FIG. 2 is an enlarged view of a selected zone of the present invention.

Please refer to FIGS. 1 and 2. The rotors for screw compressor comprise a male rotor 1 and a female rotor 2. The male rotor 1 is driven by a power source. By mean of a contacting position between the teeth of the male rotor 1 and the female rotor 2, the female rotor 2 is driven to rotate in a reverse direction. In this embodiment of the present invention, the male rotor 1 has five teeth and the female rotor 2 has six teeth.

The cross-sectional profiles of the male rotor 1 and female rotor 2 of the present invention include two sections, namely the power transmission sections 11, 21 and the compression sections 12, 22. The power transmission sections 11, 21 serve to transmit the power from the power source. The compression sections 12, 22 serve to compress the fluid into a high-pressure state. The male and female rotors 1, 2 are designed with spiral outer surfaces (not shown). Because of such spiral outer surface, at each different instant time, different teeth of power transmission sections and compression sections contact with each other. Or, different cross-sectional profiles of the same tooth contact with each other so that the power can be continuously transmitted and fluid can be continuously compressed.

In order to achieve the above object, the power transmission section 11 is composed of four continuous curves, namely circular curves AB, BC, CD and DE. The compression section 12 is composed of three continuous curves EF, FG and GH. The centers of the circular curves AB, BC, CD and DE are respectively $O_{AB}$, $O_{BC}$, $O_{CD}$ and $O_{DE}$. In order to satisfy the continuity of the connecting points of the respective curves, the center points must be specially designed. The common relationship is found that the three points of the connecting point of two adjacent circular curves and the respective centers of the two adjacent circular curves are on the same straight line. For example, $O_1$, point A and $O_{AB}$ are on the same straight line. $O_{AB}$, point B and $O_{BC}$ are on the same straight line. Point C, $O_{BC}$ and $O_{CD}$ are on the same straight line. $O_{CD}$, $O_{DE}$ and point D are on the same straight line. The curve EF is generated by circular curve fg, the curare FG is generated by circular curve gh and the curve GH is a circular curve centered at $O_1$. The profile curves ab, bc, cd and de of the power transmission section 21 of the female rotor 2 are respectively generated by the circular curves AB, BC, CD and DE of the male rotor 1.

In order to achieve a smooth transmission of power, the ratio of the angle $AO_1B$ to angle $aO_2b$ should be equal to the ratio of the tooth number of the female rotor to the tooth number of the male rotor, the ratio of the angle $BO_1C$ to angle $bO_2C$ is equal to the ratio of the tooth number of the female rotor to the tooth number of the male rotor, the ratio of the angle $CO_1D$ to angle $cO_2d$ is equal to the ratio of the tooth number of the female rotor to the tooth number of the male rotor and the ratio of the angle $DO_1E$ to angle $dO_2e$ is equal to the ratio of the tooth number of the female rotor to the tooth number of the male rotor. The curve ef is generated by point E. The curves fg, gh and hi are all circular curves and respectively centered at $O_{fg}$, $O_{gh}$ and $O_{hi}$. Points g, $O_{fg}$ and $O_{gh}$ are on the same straight line. Points h, $O_{gh}$ and $O_2$ are on the same straight line. In addition, another common relationship is found that the transmission angle ratio of the respective transmission curves of the male rotor and female rotor is in inverse proportion to the tooth number thereof. For example, the ratio of angle $EO_1F$ to angle $eO_2g$ is equal to the ratio of the tooth number of the female rotor to the tooth number of the male rotor. The ratio of angle $FO_1G$ to angle $gO_2h$ is equal to the ratio of the tooth number of the female rotor to the tooth number of the male rotor. The ratio of angle $GO_1H$ to angle $hO_2i$ is cqcual to the ratio of the tooth number of the female rotor to the tooth number of the male rotor. On the basis of the above design, the ratio of the angle contained between points A, E and $O_1$ to the angle contained between points a, e and $O_2$ is in inverse proportion to the respective tooth numbers. When the point E contacts with point e, the points E and care right on the connecting line of points $O_1$ and $O_2$. Points E and e are just the connecting points of the power transmission section and the compression section.

Thus, the present invention can achieve these objects: (1) high energy transfer efficiency, (2) low vibration noise and (3) low electricity consumption The above embodiment is only used to illustrate the present invention, not intended to limit the scope thereof. Many modifications of the above embodiment can be made without departing from the spirit of the present invention.

What is claimed is:

1. Rotors for screw compressor, comprising a male rotor and a female rotor, the male rotor being driven by a power source, by means of a contacting position between the male rotor and female rotor, the female rotor being driven to rotate in reverse direction, the male rotor having several teeth and the female rotor having several teeth, by means of a gap between the teeth of the male rotor and female rotor, fluid being sucked in and compressed into a high-pressure state, said rotors having the improvement in that:

the profile of a tooth of the male rotor is composed of seven continuous curves of four circular curves AB, BC, CD, DE and a curve EF generated by a circular curve fg, a curve FG generated by a circular curve gh and a circular curve GH; the profile of a corresponding tooth of the female rotor is composed of eight curves of curves ab, bc, cd, de generated by the circular curves AB, BC, CD, DE and a curve ef generated by point E and circular curves fg, gh and hi; wherein three points of the connecting point of two adjacent circular curves and the respective centers of the two adjacent circular curves are on a same straight line, and a transmission angle ratio of each respective transmission curve of the male rotor and female rotor is in inverse proportion to the tooth number thereof.

* * * * *